US008771473B2

(12) United States Patent
Hassinen et al.

(10) Patent No.: US 8,771,473 B2
(45) Date of Patent: Jul. 8, 2014

(54) DOCTOR BLADE FOR A FIBER WEB MACHINE AND DOCTOR ARRANGEMENT IN A FIBER WEB MACHINE

(71) Applicant: Metso Paper Inc., Helsinki (FI)

(72) Inventors: Reijo Hassinen, Leppävesi (FI); Harri Ruotsalainen, Varkaus (FR)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 13/628,226

(22) Filed: Sep. 27, 2012

(65) Prior Publication Data

US 2013/0269896 A1 Oct. 17, 2013

Related U.S. Application Data

(63) Continuation of application No. 13/514,936, filed as application No. PCT/FI2010/050966 on Nov. 26, 2010, now abandoned.

(30) Foreign Application Priority Data

Dec. 11, 2009 (FI) ..... 20096312

(51) Int. Cl.
*D21G 3/00* (2006.01)

(52) U.S. Cl.
USPC ..... 162/272

(58) Field of Classification Search
USPC ..... 162/272, 199, 281, 282; 118/126, 413; 101/169, 365
See application file for complete search history.

(56) References Cited

U.S. PATENT DOCUMENTS

| | | | | | |
|---|---|---|---|---|---|
| 4,184,429 | A | | 1/1980 | Widmer | |
| 4,780,336 | A | * | 10/1988 | Damrau | 427/356 |
| 5,021,124 | A | * | 6/1991 | Turtinen et al. | 162/199 |
| 5,032,229 | A | * | 7/1991 | Boucher | 162/281 |
| 5,112,653 | A | * | 5/1992 | Damrau et al. | 427/356 |
| 5,520,731 | A | | 5/1996 | Esser et al. | |
| 5,964,960 | A | * | 10/1999 | Boeck | 134/34 |
| 6,746,575 | B1 | * | 6/2004 | Juvakka et al. | 162/272 |
| 2004/0149414 | A1 | | 8/2004 | Watson | |
| 2006/0180291 | A1 | | 8/2006 | Rata | |

FOREIGN PATENT DOCUMENTS

| | | | |
|---|---|---|---|
| FI | 20035010 | A | 7/2004 |
| FI | 114328 | B | 9/2004 |
| FI | 20065601 | | 3/2008 |
| WO | 2008037850 | A1 | 4/2008 |
| WO | 2011070229 | A1 | 6/2011 |

OTHER PUBLICATIONS

International Search Report for PCT/FI2010/050966 dated Mar. 1, 2011.
Written Opinion of the International Searching Authority for PCT/FI2010/050966 dated Mar. 1, 2011.

* cited by examiner

*Primary Examiner* — Mark Halpern
(74) *Attorney, Agent, or Firm* — Stiennon & Stiennon

(57) ABSTRACT

A doctor blade for a fiber web machine (10) includes a blade section (11) and a fastening detent section (12). In the cross-sectional plane, the blade section (11) is asymmetric while the fastening detent section (12) is substantially symmetric so that the doctor blade (10) can be installed in two opposite positions for providing two different functions. The invention also relates to a doctor arrangement in a fiber web machine.

10 Claims, 4 Drawing Sheets

DOCTOR BLADE FOR A FIBER WEB MACHINE AND DOCTOR ARRANGEMENT IN A FIBER WEB MACHINE

CROSS REFERENCES TO RELATED APPLICATIONS

This application is a continuation application of application Ser. No. 13/514,936 filed Jun. 8, 2012, which is a U.S. national stage application of International App. No. PCT/FI2010/050966, filed Nov. 26, 2010, the disclosures of which are incorporated by reference herein, and this application claims priority on Finnish App. No. 20096312, filed Dec. 11, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a doctor blade for a fiber web machine, the doctor blade including a blade section and a fastening detent section. The invention also relates to a doctor arrangement in a fiber web machine.

Various doctor blades are used in a fiber web machine mainly for keeping the roll surfaces clean. Doctor blades can also be used for dewatering, for example, at a suction roll. Conventionally, the blade section is composed of a plate-like component having one of its edges chamfered and the edge opposite to the chamfer arranged as a fastening detent. Rivets are used in thin doctor blades, and particularly in thick doctor blades, the fastening detent can be formed in the basic material of the doctor blade. The fastening detent section ensures that the doctor blade keeps in place in the blade holder. Doctor blades are usually made of metal, plastic, fiber-reinforced plastic, or a plastic composition. Some known doctor blades are proposed in Finnish patent app. No. 20065601.

However, known doctor blades have a number of shortcomings. Firstly, several positions require a certain kind of doctor blade, which increases the number of different doctor blades in a fiber web machine. Moreover, blade holders may set additional requirements for doctor blades. For doctoring of particularly soft-surfaced rolls or belts, plastic blades are used which bend disadvantageously and the blade section of which becomes easily swaged. Plastic blades also bend easily during storage. Adaptation of a bent doctor blade to the roll surface is incomplete, which causes, for example, unevenness in the contact profile or an otherwise incomplete doctoring result. Disturbances in doctoring cause web breaks and local surface pressure variations shorten the fabric life.

SUMMARY OF THE INVENTION

It is an object of the invention to provide a novel doctor blade for a fiber web machine with more versatile functions than before. Another object of the invention is to provide a novel doctor arrangement in a fiber web machine, which arrangement can be adapted in many positions. The characteristic features of the doctor blade according to this invention are that in the cross-sectional plane the blade section is asymmetric while the fastening detent section is substantially symmetric so that the doctor blade can be installed in two opposite positions for providing two different functions. Due to the asymmetry of the blade section, the doctor blade is provided with two kinds of property, which diversifies the use of the doctor blade. In other words, one kind of a doctor blade can be used for two different purposes simply by changing the position of the doctor blade. Correspondingly, the characteristic features of the doctor arrangement according to the invention are that in the cross-sectional plane the blade section is asymmetric while the fastening detent section is substantially symmetric so that the doctor blade can be installed in the blade holder by its fastening detent section in two opposite positions for providing two different functions. A symmetric fastening detent section enables installing the doctor blade in the blade holder in both directions. With suitable dimensioning and design the doctor blade fits in the blade holders of various manufacturers. Thus the doctor blade according to the invention can be installed in most positions in which case a fiber web machine requires fewer different doctor blades compared to heretofore.

BRIEF DESCRIPTION OF THE DRAWINGS

The invention is described below in detail by making reference to the drawings which illustrate some of the embodiments of the invention.

DESCRIPTION OF THE PREFERRED EMBODIMENTS

Figure 1:
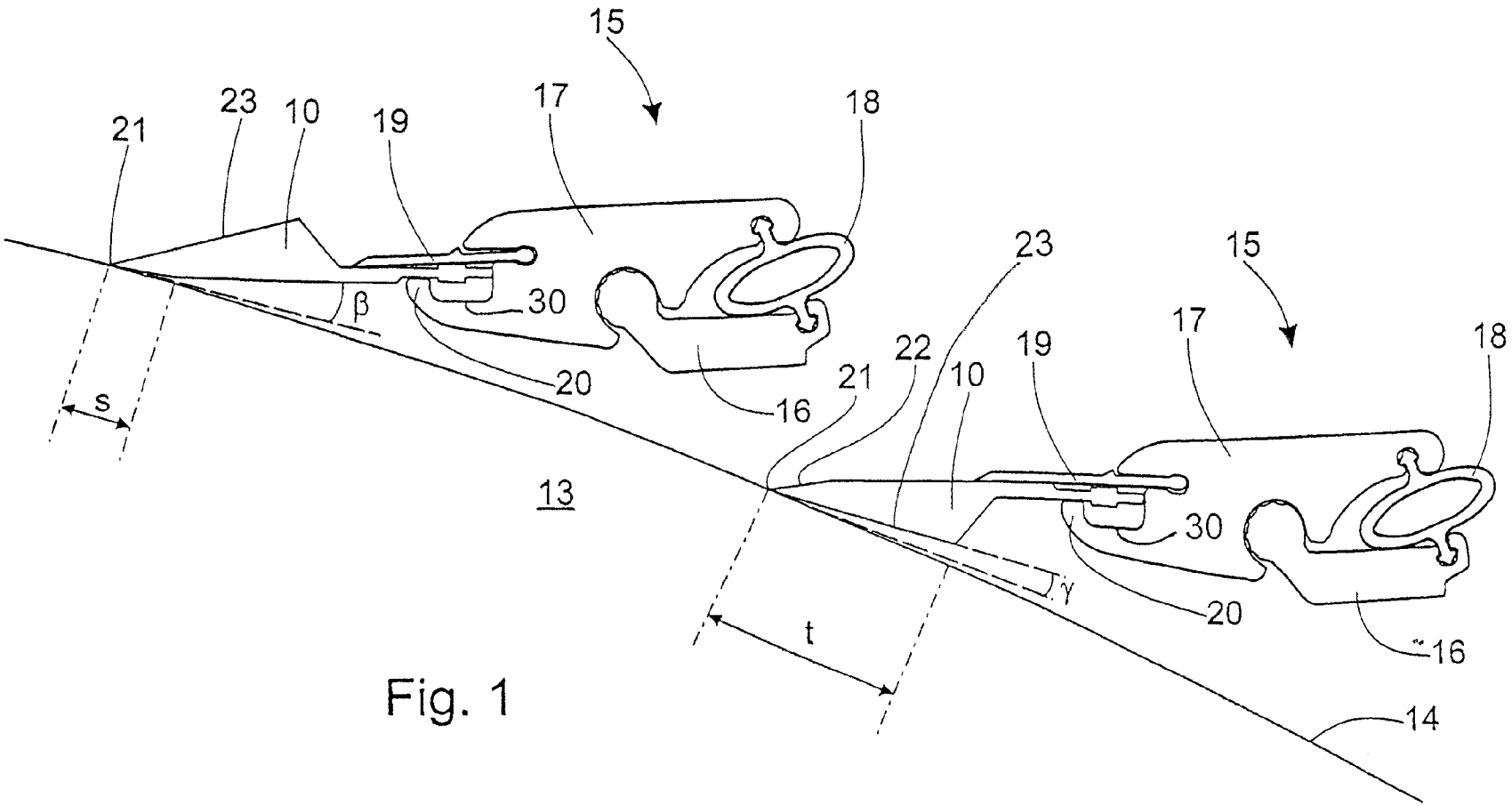
FIG. 1 shows two doctor arrangements wherein the doctor blade according to the invention is adapted to a surface to be doctored.

FIG. 1 shows two doctor arrangements according to the invention for a fiber web machine. The doctor blade included in the doctor arrangement is meant particularly for removing water and fine matter from the surface to be doctored. Specifically, the doctor arrangement according to the invention is suitable for doctoring coated rolls, belts and transfer belts as well as open-surfaced rolls. In a fiber web machine, such as a paper or board machine, open-surfaced rolls are used for several different reasons. In a suction roll, for example, the shell is perforated for leading a vacuum effect from the inside of the roll to the outside of it. The holes make the shell open-surfaced. On the other hand, grooved rolls are also used, in which the shell surface is grooved mainly for improving dewatering. A suction roll with a grooved surface also exists, the shell of which is provided with both holes and grooves. In addition to or instead of grooves, blind bores, for example, can be used. Soft coatings are also used in the rolls while belts and transfer belts are soft-surfaced by their nature. In addition, the surface of a belt, for example, can be grooved.

Figure 2A:
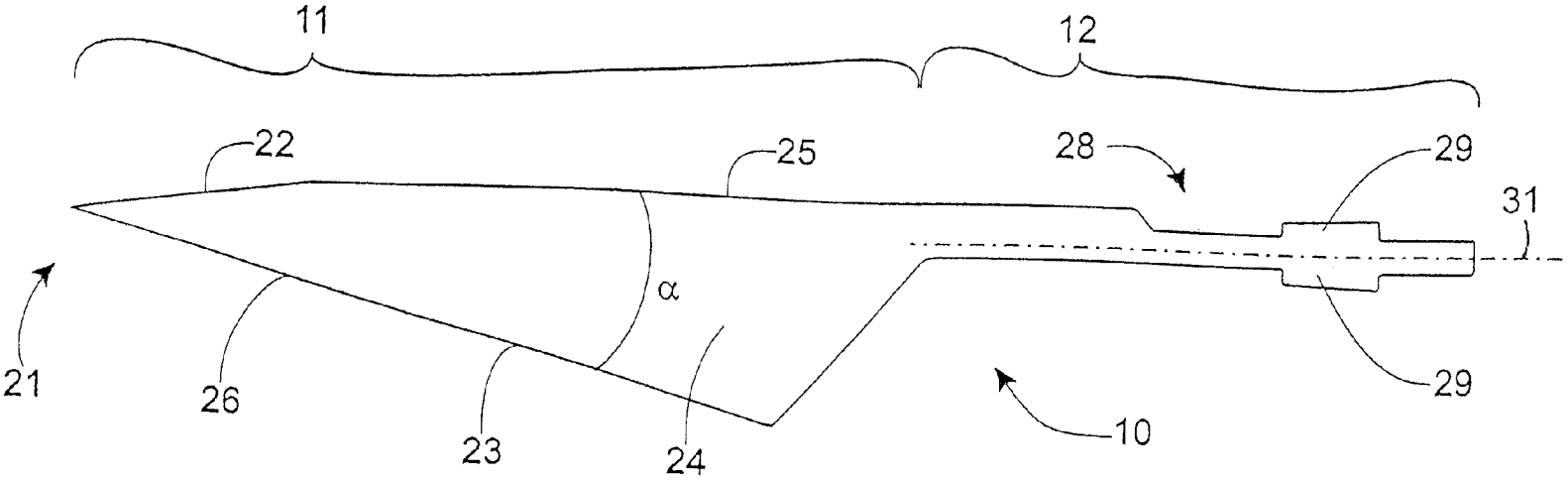
FIG. 2*a* is an end view of a first embodiment of the doctor blade according to the invention.
Figure 2B:
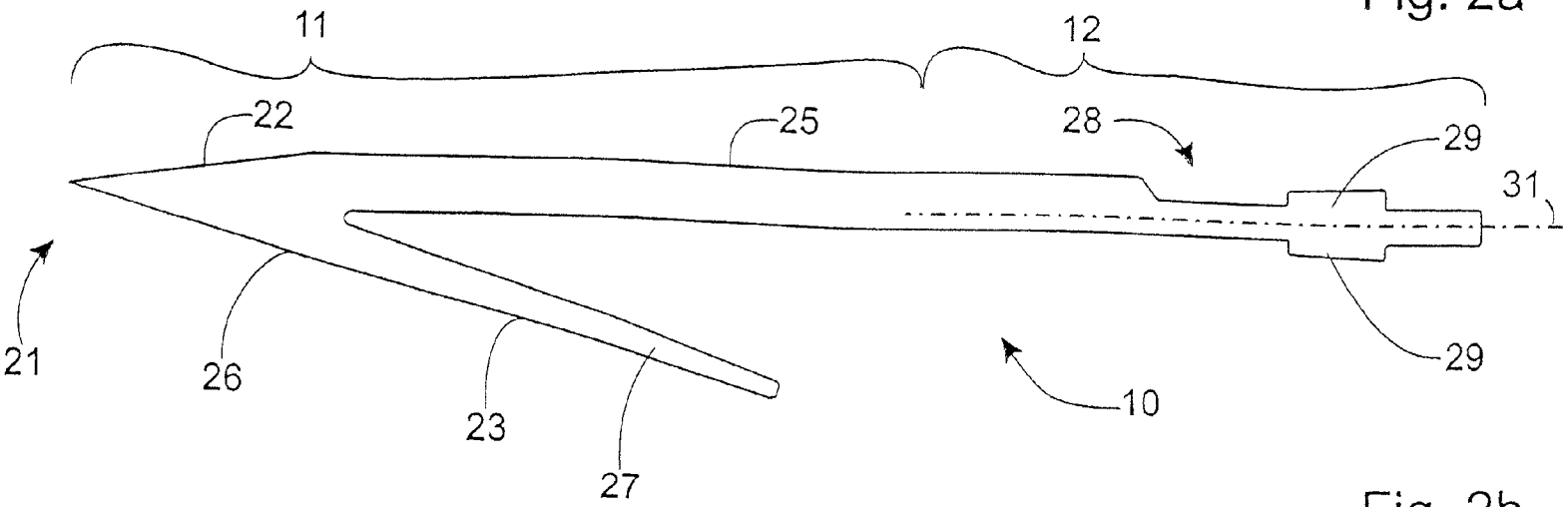
FIG. 2*b* is an end view of a second embodiment of the doctor blade according to the invention.
Figure 3:
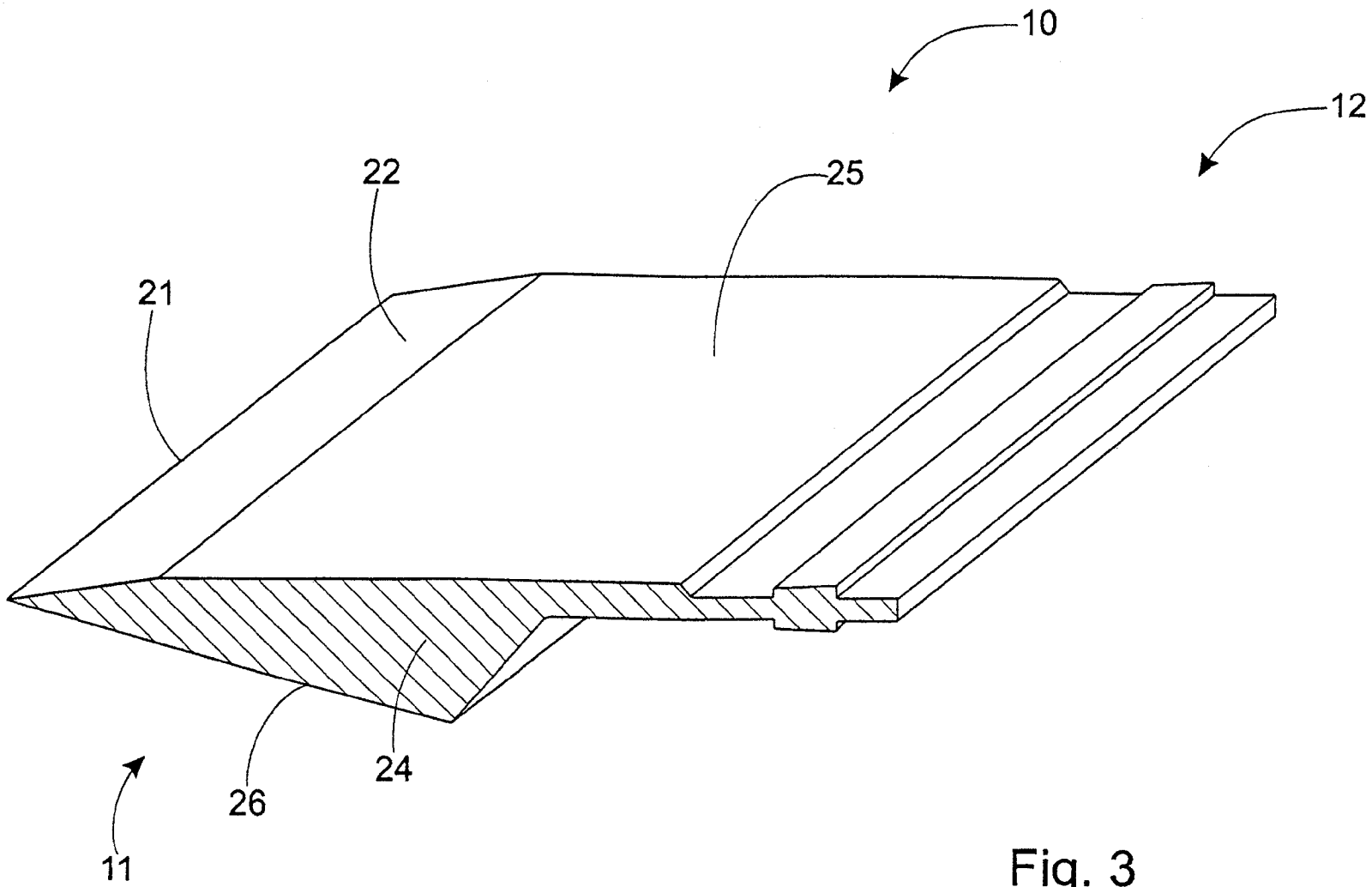
FIG. 3 is an axonometric cross-sectional view of the application example of FIG. 2*a*.

Generally, the doctor blade 10 includes a blade section 11 and a fastening detent section 12 (FIGS. 2*a* and 2*b*). In both embodiments shown in FIG. 1, the blade section 11 is adapted to a light contact with the surface 14 of the roll 13. The doctor blade 10 can be loaded, for example, with the blade holder 15 proposed, which includes a fastening plate 16 and a holder 17. The fastening plate 16 is supported to the constructions of the fiber web machine and a loading hose 18 is provided between the fastening plate 16 and the holder 17. Here the doctor blade is loaded by pressurizing the loading hose. Correspondingly, the doctor blade 10 can be detached from the surface 14 to be doctored by leading a vacuum to the loading hose 18 for a doctor blade replacement, for example. This blade holder design also includes a presser blade 19 with which the supporting and loading effect of the holder 17 can be extended sufficiently far. In addition, the characteristics of the blade holder can be varied by changing the presser blade 19.

The profiled lower clamp 20 of the holder 17 together with the presser blade 19 form a gap 30 to which the fastening detent section of the doctor blade 10 is adapted. This ensures that the doctor blade keeps in place in the blade holder while allowing at the same time easy and fast doctor blade replacement. According to the invention, the blade section is asymmetric in the cross-sectional plane while the fastening detent section is substantially symmetric so that the doctor blade can be installed in two opposite positions for providing two different functions. Due to the asymmetric design, the doctor blade is surprisingly provided with two functionalities of which the one that suits the position concerned is selected in each specific case. As is also shown in the figures, the doctor blade is turned in such a way that the surface being the bottom surface of the blade section in one application, is the top surface in the second application and vice versa. At the same time, the one and the same side of the doctor blade is in the gap 30 in both applications. In other words, the doctor blade is turned around about the center axis located in its width direction. According to FIG. 2*a*, this center axis is parallel to the axis of symmetry 31 of the fastening detent section 12. The axis of symmetry 31 is illustrated with a dot-and-dash line in FIGS. 2*a* and 2*b*.

The doctor arrangement located in the upper position of FIG. 1 corresponds to the first function according to the invention, this function being a doctoring blade. In other words, the tip 21 of the blade section 11 of the doctor blade 10 contacts the surface 14 to be doctored and removes water and impurities. Advantageously, the doctoring blade has a chamfered tip 22 for providing a contact surface as shown in the upper part of FIG. 1. With this chamfered tip 22, the formation of a linear load is avoided and the doctor blade contacts the surface to be doctored over a longer distance than in known applications. The length of the chamfered tip naturally depends on the dimensioning of the doctor blade. Generally, the length of the chamfered tip is 10-20% of the width of the doctor blade. In addition, the angle of the chamfered tip is so dimensioned that the chamfered tip can be adapted substantially according to the surface to be doctored. With such a doctor blade, a good doctoring result is achieved even with a small blade load. Furthermore, wearing of the doctor blade is reduced, and above all, the risk of damaging a soft surface is low.

The doctor arrangement located in the lower position of FIG. 1 corresponds to the second function according to the invention, this function being a foil blade. The foil blade, too, partly doctors the surface 14 with the tip 21; however, it is essential that a narrow gap is formed between the surface 14 and the doctor blade 10 in which gap a vacuum is created due to the mutual movement of the surface 14 and the doctor blade 10. This vacuum absorbs water and fine matter from the open surface, which is advantageous for the operation of the fiber web machine. Known foil blades are thick and require a holder of the kind completely of their own. Regardless of the application, the doctor blade according to the invention can be used for a blade holder of one kind. This has been achieved by forming the flow surface 23 of the foil blade from an asymmetric bulge 24 in the blade section 11. In other words, the blade section of the doctor blade is so asymmetric that it comprises a distinct bulge. Thus the blade holder can be placed in a normal position and used in a normal way.

The dimensioning of the bulge depends greatly on the dimensioning of the doctor blade. Generally, the effective length of the flow surface is about half of the width of the doctor blade. For example, in a 100 mm wide doctor blade, the effective length t of the flow surface 23 is 30-60 mm, more advantageously 40-55 mm. The effective length is also influenced by the rest of the design of the doctor blade. According to the invention, the bulge 24 forms a wedge-shaped blade section 11, whose angle $\alpha$ between the outer surfaces 25 and 26 is 10-30°, more advantageously 15-20° (FIG. 2*a*). Generally, as this angle grows, the effective length shortens. However, this shortening can be compensated by the design of the doctor blade.

The doctor blade 10 of FIG. 2*a* is dimensioned with consideration to known blade holders. Here the width of the doctor blade is in a class of 100 mm, but narrower or wider ones than this can also be manufactured. Great freedom exists for the dimensioning of the bulge, whereas the fastening detent section must be sufficiently thin to fit in the gap 30. Here the minimum thickness of the doctor blade is approximately 2.5 mm in which case it suits known blade holders. The thinned part forms a neck 28 which is symmetric together with shoulders 29. Thus the doctor blade can be adapted in the blade holder in two different ways while the holder composed by the shoulders keeps the doctor blade in the gap. The width of the thin area is approximately 25 mm, after which the thickness of the doctor blade increases at least to four millimeters. With this thickening, harmful bending of the doctor blade is avoided.

Besides the novel doctor blade, the blade arrangement according to the invention has new features. According to the invention, the blade section is thus asymmetric in the cross-sectional plane while the fastening detent section is substantially symmetric so that the doctor blade can be installed by its fastening detent section in two opposite positions for providing two different functions. In addition, in the first function, the doctor blade 10 has mainly a doctoring function and it is so adapted that the angle $\beta$ between the doctor blade 10 and the surface 13 to be doctored is 6-16°, more advantageously 10-14° (FIG. 1). Then the blade angle formed is advantageously small, whereby it is avoided that the doctor blade bites the soft surface. The biting tendency is also reduced by the above mentioned chamfered tip.

In the second function of the doctor arrangement the foil blade is so adapted that the angle $\gamma$ between the doctor blade 10 and the surface 13 to be doctored is 1-10°, more advantageously 4-6° (FIG. 1). The slightly growing gap forms an efficient vacuum effect. At the same time, a space is formed for water between the flow surface and the surface. Advantageously, the doctor arrangement is placed so that water can drop down by gravity after the flow surface. Suction rolls, for example, are provided with collecting pans of their own, while from grooved rolls, water flows to the pans of the press and further to the sewerage. Detached water can also be doctored with another doctor blade according to the invention.

A doctor blade according to the invention is advantageously made of a plastic material so that the doctor blade can be used for doctoring soft roll surfaces, belts and transfer belts. There are several possible plastic materials but advantageously HD or LD polyethylene or polypropylene is used. The raw material of the final product has a high molecular weight and selected alloying additives are used in the manufacture. Specifically, by maximizing the polymerization degree and saturating the raw material with dry grease material and finally by sinter-pressing, a wear resistant and rigid final product is achieved, which is additionally stress-free and stable in form.

Using such a material, a doctor blade according to the invention can be manufactured by machining. The production method also enables to manufacture long pieces. Thus the completed doctor blade is seamless. When the doctor blade includes an integral fastening detent section, separate rivetings are unnecessary.

FIG. 2*b* shows the second embodiment of the doctor blade 10 according to the invention. Dimensioning and profiling corresponds to the embodiment of FIG. 2*a* excluding the flow surface 23 of the foil blade. Here the bulge 24 is formed with a wing 27. The partly open construction reduces the amount of raw material and the design is also suitable for manufacturing by pultrusion. Pultrusion also enables to manufacture a hollow bulge (not shown). On the other hand, the doctor blade can be manufactured by combining several pieces. For example, a key-like component can be fastened to a wedge-shaped blade blank as a bulge.

Figure 4:
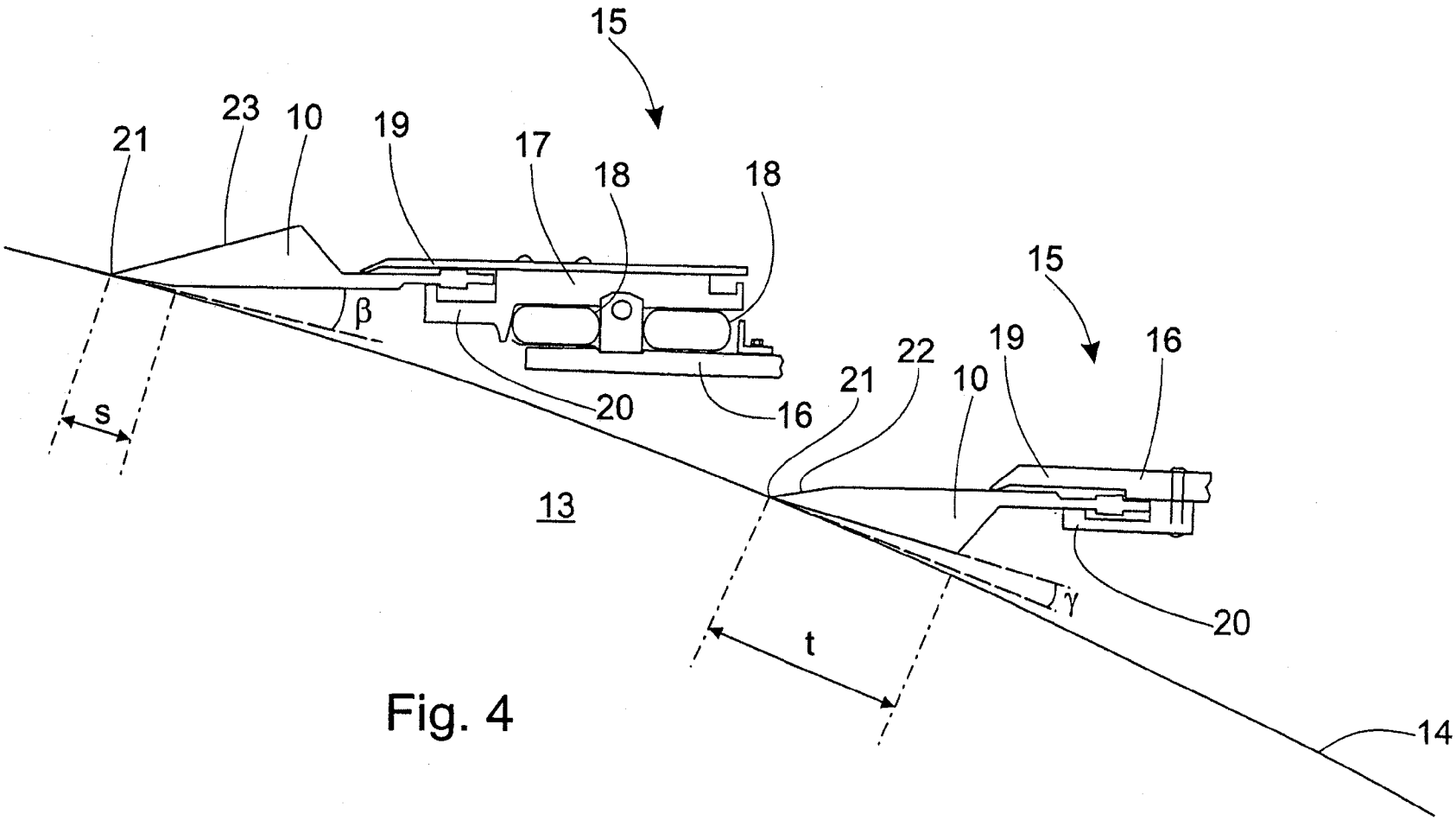
FIG. 4 shows a modification of the doctor arrangement according to FIG. 1.

FIG. 4 shows a modification of the doctor arrangement according to the invention. Here the universal applicability of the doctor blade 10 is illustrated using two different blade holders 15. Functionally similar parts are referred to using identical reference numbers. FIG. 4 shows a so called DST blade holder on the left-hand side provided with two loading hoses 18. The functional presser blade 19 is composed of an upper plate fastened to the holder 17. FIG. 4 shows a so called K35 blade holder on the right-hand side which is rigid and has been fastened to the doctor beam provided with loading elements (not shown). Here the functional presser blade 19 is composed of the fastening plate 16 of the holder. In addition to these, the doctor blade according to the invention also suits other types of blade holders, such as the Metso Paper Inc. FiberDoc blade holder, for example. Blade holders can also be provided with a presser blade. In addition, the blade holder can be made of a composite or a metal material.

The doctor blade according to the invention is so universal in design that it can be adapted to almost all known blade holders. Moreover, the surprising dual function covers most doctoring positions and requirements. By simply turning the doctor blade, either a doctoring blade or a foil blade is provided. In case the position allows it, a doctor blade that has been used in a doctoring application can be adapted as a foil blade when worn. On the other hand, applicable surface pressures are low and the blade material is wear-resistant so that the doctor blade remains operational for a long time. With the blade according to the invention it is possible to remarkably reduce the number of different doctor blades in a fiber web machine. Moreover, a novel doctor blade can be taken into use without major equipment changes or investments.

We claim:

1. A doctor blade for a fiber web machine, the doctor blade comprising:

a fastening detent section terminating in a blade attachment end;

a blade section, the blade section terminating at a tip, opposite the attachment end;

wherein a cross-sectional plane is defined with respect to the doctor blade which extends in a width from the blade section tip to the blade attachment end and in a thickness perpendicular to the width;

wherein an axis of symmetry is defined which lies in the cross-sectional plane of the doctor blade, and extends from the attachment end toward the tip, and about which the fastening detent section of the doctor blade is substantially symmetric;

wherein the blade section is asymmetric about the axis of symmetry;

wherein the doctor blade has a first part of the blade section at least above the axis of symmetry, and a second part of the blade section at least mostly below the axis of symmetry;

wherein the first part has a first surface which originates at the tip and extends away from the axis of symmetry at a first angle a first distance in a direction toward the attachment end, and a second surface which joins the first surface and extends in relation to the axis of symmetry at a second angle in the direction toward the attachment end, the second angle being less than the first angle, wherein the first surface and the second surface form the first part which is arranged to function as a doctor blade; and wherein the second part has a foil blade surface which originates at the tip and extends away from the axis of symmetry in the direction toward the attachment end a second distance which is greater than the first distance, said foil blade surface being arranged to function as a foil blade and defines an asymmetric bulge extending from the axis of symmetry, and wherein the foil blade surface forms an angle with the second surface of the first part of the blade section of between 10°-30°.

2. The doctor blade of claim 1 wherein the doctor blade is a unitary seamless machined part of plastic material.

3. The doctor blade of claim 2 wherein the doctor blade is a unitary seamless machined part of HD or LD polyethylene.

4. The doctor blade of claim 2 wherein the doctor blade is a unitary seamless machined part of polypropylene.

5. The doctor blade of claim 1 wherein the doctor blade is a unitary plastic pultrusion.

6. The doctor blade of claim 1 wherein the foil blade surface forms an angle with the second surface of the first part of the blade section of between 15°-20°.

7. The doctor blade of claim 1 wherein the first part of the blade section first surface extends 10-20 percent of the width of the doctor blade.

8. The doctor blade of claim 1 wherein the doctor blade is dimensioned to have a width of about 100 mm, and a doctor blade minimum thickness of approximately 2.5 mm, and wherein the fastening detent section terminating in the blade attachment end is formed by said minimum thickness part forming a neck which has shoulders extending to a total thickness of at least four millimeter, said neck and shoulders being symmetric about the axis of symmetry so the doctor blade can be positioned in a blade holder in a first position and in a second position where the doctor blade is arranged rotated 180 degrees about the axis of symmetry in the blade holder.

9. The doctor blade of claim 1 wherein the foil blade surface has an effective length of 30-50 mm along the width.

10. The doctor blade of claim 1 wherein the foil blade surface has an effective length of 35-45 mm along the width.

* * * * *